US007025642B1

(12) United States Patent
Baylor

(10) Patent No.: US 7,025,642 B1
(45) Date of Patent: Apr. 11, 2006

(54) BOAT PROPELLER

(75) Inventor: Wesley Terran Baylor, Garden Grove, CA (US)

(73) Assignee: Lear Baylor, Inc., Garden Grove, CA (US)

( * ) Notice: Subject to any disclaimer, the term of this patent is extended or adjusted under 35 U.S.C. 154(b) by 0 days.

(21) Appl. No.: 10/942,333

(22) Filed: Sep. 16, 2004

(51) Int. Cl.
*B63H 1/14* (2006.01)

(52) U.S. Cl. ..... 440/49; 416/197 R; 416/235

(58) Field of Classification Search ..... 440/49; 416/197 R, 234, 235
See application file for complete search history.

(56) References Cited

U.S. PATENT DOCUMENTS

| | | | | |
|---|---|---|---|---|
| 33,077 | A | 8/1861 | Elliott | |
| 535,271 | A | 3/1895 | Armstrong | |
| 698,582 | A | 4/1902 | Strothman | |
| 1,030,047 | A | 6/1912 | Ames | |
| 1,041,912 | A | 10/1912 | Tyson | |
| 1,110,979 | A | 9/1914 | Agan | |
| 1,117,103 | A | 11/1914 | Steinbach | |
| 1,597,175 | A | 8/1926 | Boening | |
| 2,086,307 | A | 7/1937 | Stewart | |
| 2,754,919 | A | 7/1956 | Blue | |
| 2,978,040 | A | 4/1961 | Wirkkala | |
| 4,632,636 | A | 12/1986 | Smith | |
| D319,210 | S | 8/1991 | Koepsel et al. | |
| 6,086,438 | A * | 7/2000 | Wang | 440/49 |
| 6,247,897 | B1 * | 6/2001 | Patel | 416/197 R |
| 6,352,408 | B1 | 3/2002 | Kilian | |

* cited by examiner

*Primary Examiner*—Lars A. Olson
(74) *Attorney, Agent, or Firm*—Walter A. Hackler

(57) ABSTRACT

A boat propeller includes a hub having a front, back, and an axis of revolution extending therebetween. A plurality of blades provide and extend from the hub between the front and back. Each blade includes a surface adjacent of the hub disposed at an oblique angle to the hub axis and a blade tip having an adjacent surface forming a dihedral angle with a surface adjacent to the hub extended on the forward camber only. The surface adjacent to the blade tip is inclined at a greater angle to the hub axis than the surface adjacent to the hub. Each blade includes a trailing edge extending radially from the hub with each trailing edge being substantially straight and a tip is provided joining the trailing edges at approximately a 90° angle. An arcuate leading edge is provided between each blade tip and a hub and a flange is disposed on each blade tip and extends parallel to the hub axis toward the hub back.

7 Claims, 2 Drawing Sheets

BOAT PROPELLER

The present invention generally relates to boat propellers and is more particularly directed to an improved boat propeller design for electric boats.

A great number of people enjoy recreational boating utilizing a great number of different styles of watercraft. One class of these boats includes electric boats which are ideal for harbor or bay cruising which are generally congested with a great number of docks and moorages.

While an acceptable level of forward thrust in prior art propellers has been available, such propulsion systems often lack of adequate reverse thrust. This has generally resulted in poor controllability of the boat.

While the use of larger propellers combined with larger power plants can provide for greater controllability. Such an option is generally not available for boats powered by an electric motor.

Consequently, there is a need for an improved boat propeller design, which includes blade configuration for providing efficient forward propulsion of a boat while also providing reverse efficiency to improve control of the boat.

SUMMARY OF THE INVENTION

A boat propeller in accordance with the present invention generally includes a hub having a front, back, and axis of rotation extending therebetween. A plurality of blades are provided and extend from the hub between the front and back with each blade having a surface adjacent the hub disposed in an oblique angle to the hub axis and a blade tip having an adjacent surface forming a dihedral angle with a surface adjacent the hub.

The surface adjacent to the blade tip is inclined at a greater angle to the hub than the surface adjacent to the hub.

More particularly, each blade includes a trailing edge extending radially from the hub with each trailing edge being substantially straight.

Each blade includes a blade tip adjoining a respective trailing edge at approximately a 90° angle and an arcuate leading edge extends between a respective blade tip and hub. Each of the leading and trailing edges extend to and abut the hub.

A flange is provided and disposed on each blade tip and extends parallel to the hub axis toward the hub back. More particularly, the flange may be disposed at approximately a 90° angle with the surface adjacent the blade tip and the flange may include an arcuate edge extending between the leading and trailing edges. The flange is on the forward camber only.

Preferably, the blades are spaced apart around the hub without overlap as viewed along the hub axis and a plurality of five blades may be provided.

The propeller further may include a conical spinner having a streamlined intersection with the hub front for enabling streamline flow of water therepast.

Core holes in the hub disposed around the axis may also be provided for preventing shrinkage of the propeller during manufacture, particularly when the material manufacture includes urethane, or the like. The core holes are only needed when the hub diameter causes the mass off material to be great enough as to cause shrink distortion in the manufacturing process.

In addition, an efficiency of the propeller in accordance with the present invention is enhanced when the leading edge, trailing edge, and the flange arcuate edge comprise featheredges.

BRIEF DESCRIPTION OF THE DRAWINGS

The advantages of the present invention will be more clearly understood with reference to the following detailed description when considered in conjunction with the appended drawings of which.

DETAILED DESCRIPTION

Figure 1:
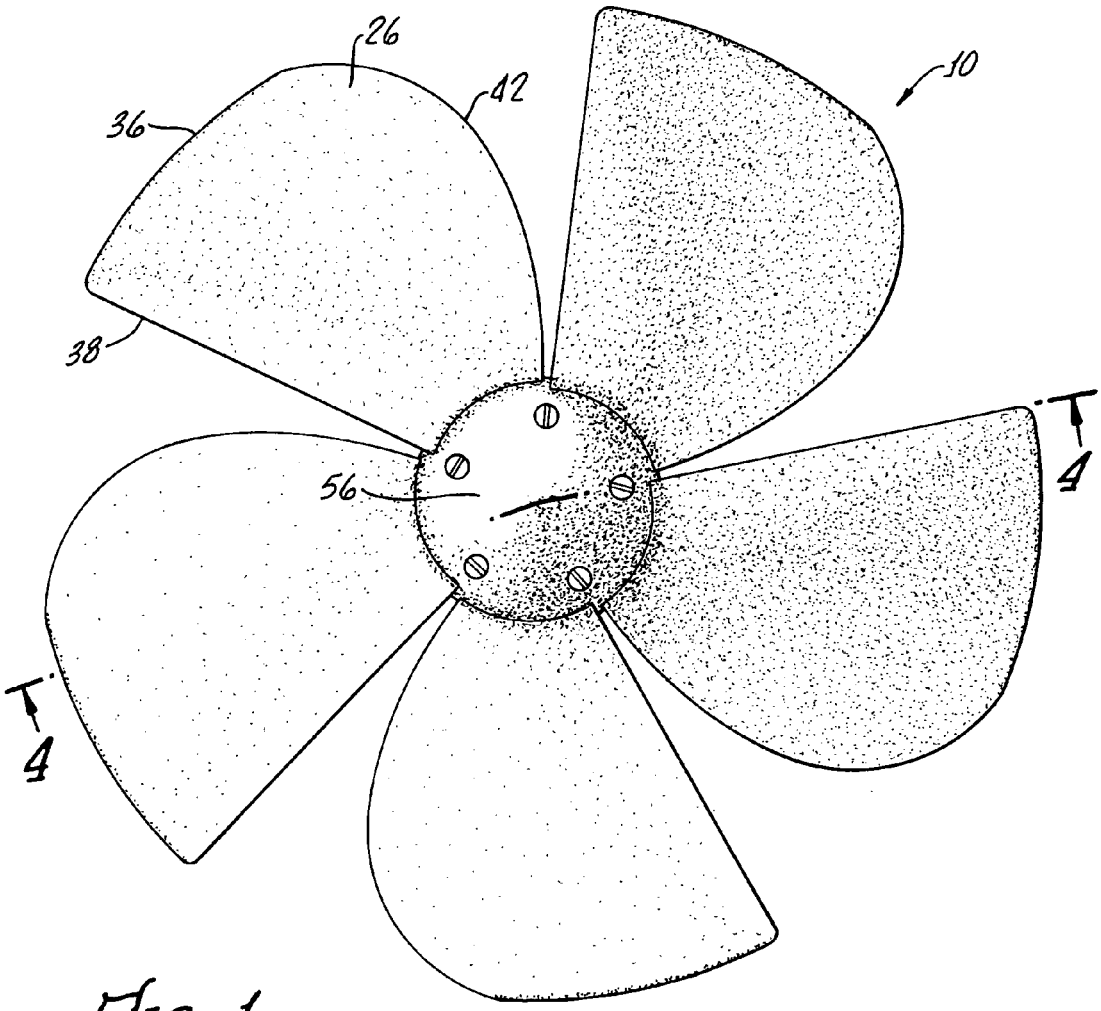
FIG. 1 is a plan back view of a boat propeller in accordance with the present invention generally showing a hub and a plurality of blades extending therefrom.

With reference to FIG. 1, there is shown a non-metallic boat propeller 10 in accordance with the preset invention. The propeller 10 is molded or cast from a material such as, for example, urethane.

Figure 2:
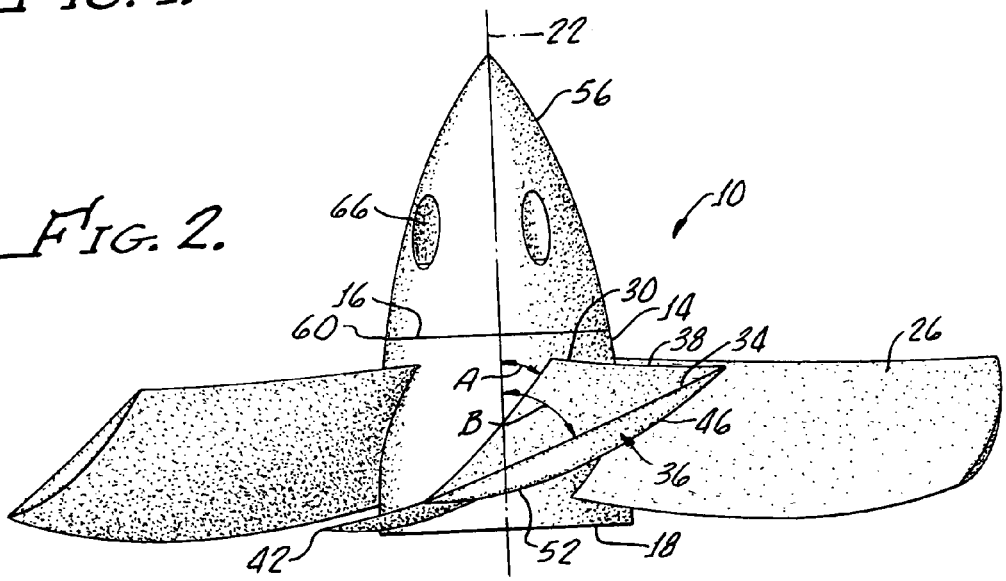
FIG. 2 is a side view of the propeller shown in FIG. 1 illustrating blades having a surface adjacent to the hub disposed in an oblique angle to the hub axis and a blade tip having an adjacent surface forming a dihedral angle with the surface adjacent the hub.
Figure 3:
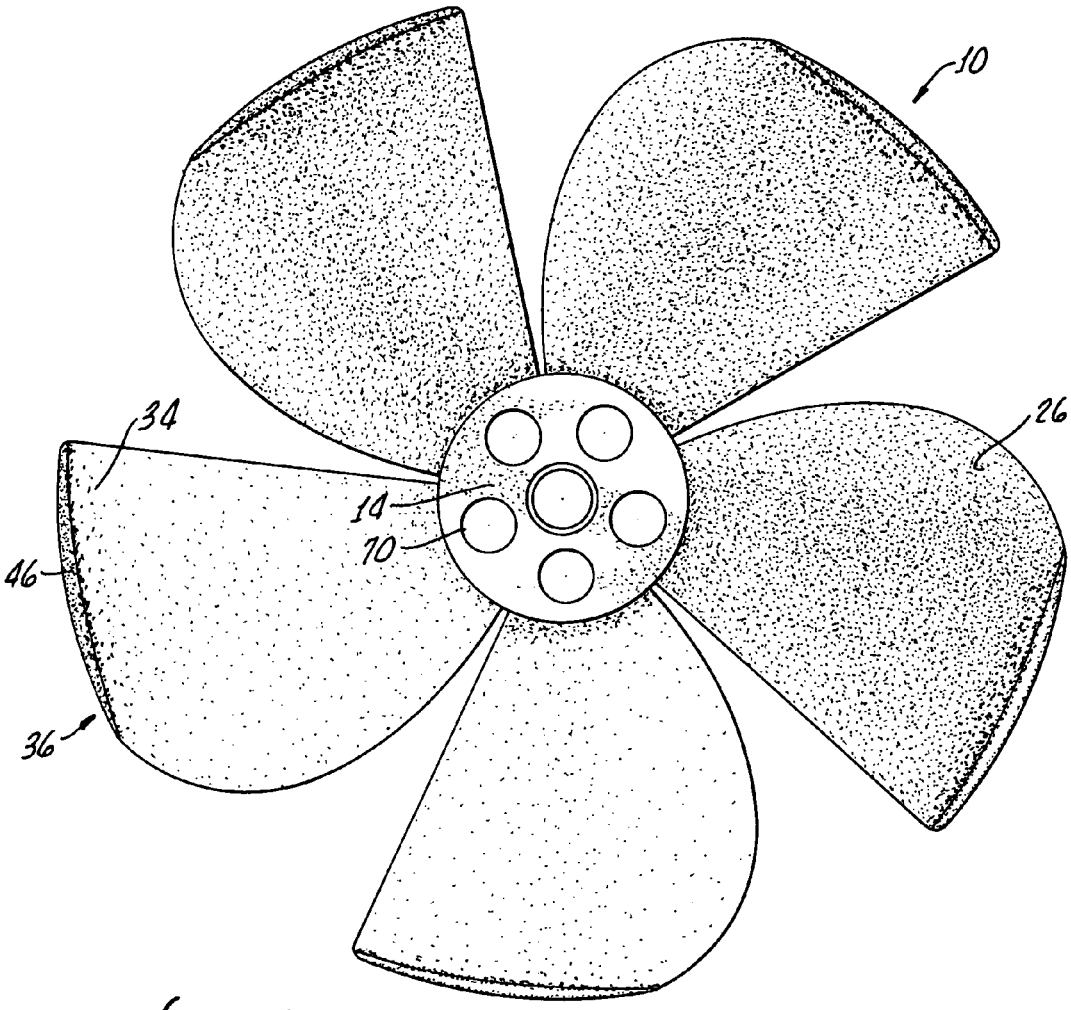
FIG. 3 is a plan front view of the propeller in accordance with the present invention.
Figure 4:
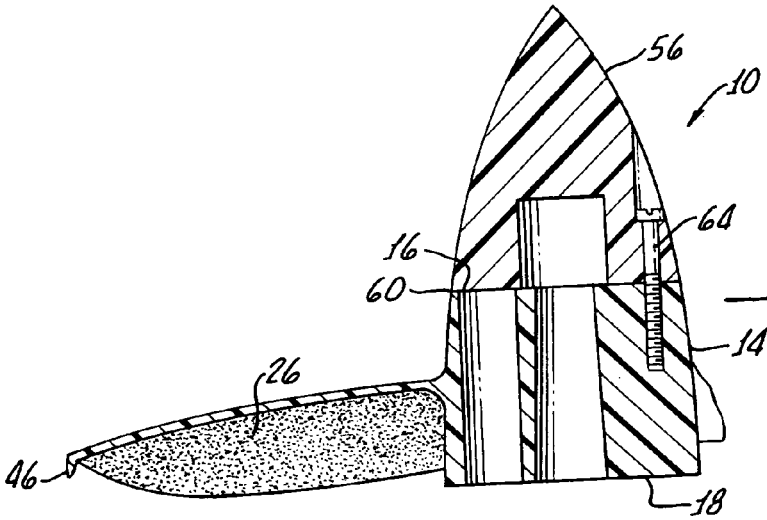
FIG. 4 is a cross sectional view of the propeller shown in FIG. 3 illustrating a conical spinner having a streamline intersection with the hub front and a depending flange.

As more easily seen from FIGS. 2–4, the propeller 10 includes a hub 14 having a back 16, a front 18, and axis 22 of rotation. A plurality of blades 26 extend from the hub 14 and, as best shown in FIG. 2, each blade includes a surface 30 adjacent the hub 14 disposed at an oblique angle to the hub axis 22. Each blade 26 further includes a surface 34 adjacent a corresponding blade tip 36 which forms a dihedral angle, or pitch, with the surface 30 adjacent the hub 14. The surface 34 adjacent the blade tip 36 being inclined at a greater angle to the hub, axis 22, than the surface 30 adjacent the hub 14.

This is indicated by the angles A and B.

In addition, each blade 26 includes substantially straight trailing edge 38 and the blade tip 36 is disposed approximately a 90° to the trailing edge 38. The straight trailing edge is the reason for greater acceleration and more thrust. The trailing edge of available propellers are arcuate, thus reducing the chord, and therefore the lift, for approximately ⅓ of the outer diameter. High rpm may make up for this loss but such high rpm is not available on electric boats.

An arcuate leading edge 42 stands between each blade tip 36 and the hub 14.

As most clearly shown in FIGS. 3 and 4, the flange 46 is preferably disposed at approximately a 90° angle with the surface 34 adjacent to the blade tip 46. In addition, as shown in FIG. 2, the flange 46 includes an arcuate edge 52 extending between the leading edge 42 and trailing edge 38.

Preferably, the propeller 10 includes five blades 26 which are arranged in a spaced apart relationship around a hub without overlap when viewed along the hub axis 22, as best shown in FIGS. 1 and 3. As shown in FIGS. 1–2 and 3, the propeller in accordance with the present invention further includes a conical spinner 56 in a streamlined intersection 60 with the hub back 16.

The spinner 56 may be attached to the hub through the use of screws 64 through aft facing holes 66.

In addition, core holes 70 may be provided to prevent or minimize shrinkage of the propeller 10 during manufacture from urethane as hereinabove noted.

In addition, the leading edge, trailing edge, and flange arcuate edge, featheredges, that is, very thin.

The flange 46 functions to provide more control of the propeller in reverse operation by resisting tip slip. Further, the flanges 46 act as blade stiffeners and provide a blunt end for the blades 26 which reduces the risk of injury of marine life if contact therewith occurs.

The propeller 10 is preferably designed for an electric boat and hence its nonmetallic composition is ideal therefore.

At operational speeds of less than 750 rpm little propeller disturbance or cavitation occurs through the operation of the propeller 10 in accordance with the present invention.

Although there has been hereinabove described a specific boat propeller in accordance with the present invention for the purpose of illustrating the manner in which the invention may be used to advantage, it should be appreciated that the invention is not limited thereto. That is, the present invention may suitably comprise, consist of, or consist essentially of the recited elements. Further, the invention illustratively disclosed herein suitably may be practiced in the absence of any element which is not specifically disclosed herein. Accordingly, any and all modifications, variations or equivalent arrangements which may occur to those skilled in the art, should be considered to be within the scope of the present invention as defined in the appended claims.

The invention claimed is:

1. A boat propeller comprising:

a hub having a front, back, and an axis of rotation extending therebetween;

a conical spinner having a streamlined intersection with the hub front; and five blades extending from said hub between the front and back and each blade having a surface adjacent said hub disposed at an oblique angle to the hub axis and a blade tip having an adjacent surface forming a dihedral angle with the surface adjacent said hub, the surface adjacent the blade tip being inclined at a greater angle to the hub axis than the surface adjacent said hub, said blades being spaced apart around said hub without overlap when viewed along the hub axis, each blade further comprising:

a trailing edge extending radially from said hub, each trailing edge being substantially straight;

a blade tip joining a respective trailing edge at approximately a 90° angle;

an arcuate leading edge extending between a respective blade tip and said hub;

a flange disposed on each blade tip and extending parallel to the hub axis toward the hub back, said flange being disposed at approximately a 90° angle with the surface adjacent to the blade tip and including an arcuate edge extending between the leading and trailing edges.

2. The propeller according to claim 1 wherein said hub and blades comprise urethane.

3. The propeller according to claim 2 wherein said hub includes core holes for preventing shrinkage of the propeller during manufacture.

4. The propeller according to claim 1 wherein the leading edge, trailing edge and flange arcuate edge comprises featheredges.

5. A boat propeller comprising:

a hub having a front, back, and an axis of rotation extending therebetween;

a conical spinner having a streamlined intersection with the hub front; and five blades extending from said hub between the front and back and each blade having a surface adjacent said hub disposed at an oblique angle to the hub axis and a blade tip having an adjacent surface forming a dihedral angle with the surface adjacent said hub, the surface adjacent the blade tip being inclined at a greater angle to the hub axis than the surface adjacent said hub, said blades being spaced apart around said hub without overlap when viewed along the hub axis, each blade further comprising:

a trailing featheredge extending radially from said hub, each trailing edge being substantially straight;

a blade tip joining a respective trailing edge at approximately a 90° angle;

an arcuate leading featheredge extending between a respective blade tip and said hub;

a flange disposed on each blade tip and extending parallel to the hub axis toward the hub back, said flange being disposed at approximately a 90° angle with the surface adjacent to the blade tip and including an arcuate featheredge extending between the leading and trailing edges.

6. The propeller according to claim 5 wherein said hub and blades comprise urethane.

7. The propeller according to claim 6 wherein said hub includes core holes for preventing shrinkage of the propeller during manufacture.

* * * * *